US006453792B1

(12) United States Patent
Hampton

(10) Patent No.: US 6,453,792 B1
(45) Date of Patent: Sep. 24, 2002

(54) GUN TRUNNION ANGULAR-SENSING MECHANISM

(75) Inventor: Michael F. Hampton, Zionsville, IN (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/577,794

(22) Filed: May 24, 2000

Related U.S. Application Data

(60) Provisional application No. 60/162,442, filed on Oct. 29, 1999.

(51) Int. Cl.[7] ..... F41A 25/00
(52) U.S. Cl. ..... 89/37.07
(58) Field of Search ..... 89/37.07, 41.11, 89/40.03, 41.17

(56) References Cited

U.S. PATENT DOCUMENTS 3,677,134 A * 7/1972 Maximi et al. ..... 89/41.19
3,687,004 A * 8/1972 Faisandier ..... 89/33.02
4,193,334 A * 3/1980 Jackson ..... 356/254
4,348,939 A * 9/1982 Hipp ..... 89/41.03
4,577,546 A * 3/1986 Jackson ..... 89/203
4,723,851 A * 2/1988 Troster et al. ..... 384/504
4,885,977 A * 12/1989 Kirson et al. ..... 89/41.05
5,062,347 A * 11/1991 Alias et al. ..... 89/37.07
5,353,680 A * 10/1994 Tiomkin et al. ..... 89/37.03
5,648,633 A * 7/1997 Relange ..... 89/41.11

* cited by examiner

*Primary Examiner*—Charles T. Jordan
*Assistant Examiner*—John W. Zerr
(74) *Attorney, Agent, or Firm*—William C. Schubert; Glenn H. Lenzen, Jr.

(57) ABSTRACT

A gun trunnion angular-sensing mechanism (30) is operable with a gun (20) mounted for elevational rotation on a gun trunnion (22). The angular-sensing mechanism (30) includes an angular-position readout device (32) having an input shaft (34), and a pinned parallelogram linkage (46) extending between the gun trunnion (22) and the input shaft (34) of the angular-position readout device (32). The linkage (46) rotates the input shaft (34) proportionately to a rotation of the gun trunnion (22), so that the angular position of the gun trunnion (22) may be sensed.

23 Claims, 2 Drawing Sheets

GUN TRUNNION ANGULAR-SENSING MECHANISM

This application claims the benefit of U.S. provisional application No. 60/162,442, filed Oct. 29, 1999

BACKGROUND OF THE INVENTION

This invention relates to large guns such as guns mounted in tank turrets and, more particularly, to a mechanism for sensing the angular elevation of the gun.

Large guns such as those in tank turrets are usually mounted on a gun trunnion, which in turn is supported on a base. The gun trunnion is essentially a horizontal shaft which allows the gun to be rotated about the horizontal axis to vary the elevational angle of the gun barrel. The gunner operates an elevating mechanism to rotate the gun about the gun trunnion, thereby changing the upward angle of the gun. The azimuthal angle is controlled by rotating the base on which the gun trunnion is mounted.

These two movements of the gun, the elevational and azimuthal movements, are the primary variables available to the gunner to aim the gun. It is therefore vital to know the exact value of the elevation and azimuth angles of the gun.

The elevational angle relative to the base may be determined by a visual estimate. While this is sufficient for some purposes, other situations require that the elevational angle be determined by an instrument whose readout is provided to a fire controller. For example, the aiming of the gun of a tank when the tank is moving, and the base is pitching, requires the ability to read the elevational angle automatically and provide that elevation to a fire-control computer. Gun trunnion-mounted instruments are available to make these elevational measurements and are operable in some circumstances. In other cases, however, such as retrofits of some gun systems found in older tanks and the like, the gun trunnion may not be accessible for attachment of the elevational angular-measurement instrument.

There have been attempts to design measurement instrumentation to automatically determine the elevational angle of a large gun. However, these prior devices have structures which the present inventor has determined yield inaccurate results due to the presence of slip joints in the mechanical linkages between the gun and the readout device. The inaccuracies result in imprecise aiming of the gun.

There is therefore a need for an alternative approach which is usable to accurately measure the elevational angle of a gun trunnion-mounted gun in those cases where the instrumentation may not be attached directly to the gun trunnion. The present invention fulfills this need, and further provides related advantages.

SUMMARY OF THE INVENTION

The present invention provides a gun trunnion elevational angular-sensing mechanism which is usable with a gun whose gun trunnion is not readily accessible for direct attachment of the angular-position readout device. The angular-sensing mechanism is highly accurate yet rugged. It accommodates variations between individual gun arrangements, such as those within the turret of a tank.

In accordance with the invention, a gun trunnion angular-sensing mechanism operable with a gun having a gun trunnion comprises an angular-position readout device having an input shaft, which is desirably supported on a bearing structure for stability, and a linkage including two pinned joints and extending between the gun trunnion and the input shaft of the angular-position readout device. The linkage rotates the input shaft proportionately to a rotation of the gun on the gun trunnion, preferably with a unity proportionality constant so that the rotation of the input shaft is exactly the same as that of the rotation of the gun trunnion. Preferably, the angular-position readout device is an angular resolver utilizing an inductive coil, and the linkage is a parallelogram linkage.

More specifically, one embodiment of the gun trunnion angular-sensing mechanism, operable with the gun mounted for elevational rotation on the gun trunnion, comprises an angular-position readout device having an input shaft, and a linkage rotating the input shaft by the same amount as a rotation of the gun trunnion. The linkage comprises a gun trunnion arm affixed at a first end thereof to the gun trunnion and rotating with the gun trunnion, the gun trunnion arm having a gun trunnion-arm length; a control arm parallel to the gun trunnion arm and having a control-arm length equal to the gun trunnion-aim length, the control arm being affixed at a first end thereof to the input shaft of the angular-position readout device; a fixed arm comprising a body which is fixed relative to the gun trunnion and the angular-position readout device, and having a fixed-side length measured between the gun trunnion and the angular-position readout device; and a linkage arm having a linkage-arm length equal to the fixed-side length, the linkage arm being pivotably attached at a first end thereof to a second end of the gun trunnion arm and being pivotably attached at a second end thereof to a second end of the control arm. The pivots are preferably accomplished with double-row, angular contact, ball bearings.

The angular-sensing mechanism of the invention is particularly useful in relation to the guns of tanks that have an arm extending downwardly from the gun trunnion, which may be used as the gun trunnion arm. An example is the M60A3 tank now in service throughout the world. The present approach allows the elevational angle to be sensed automatically and continuously, so that automatic fire control is possible even when the tank is moving.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
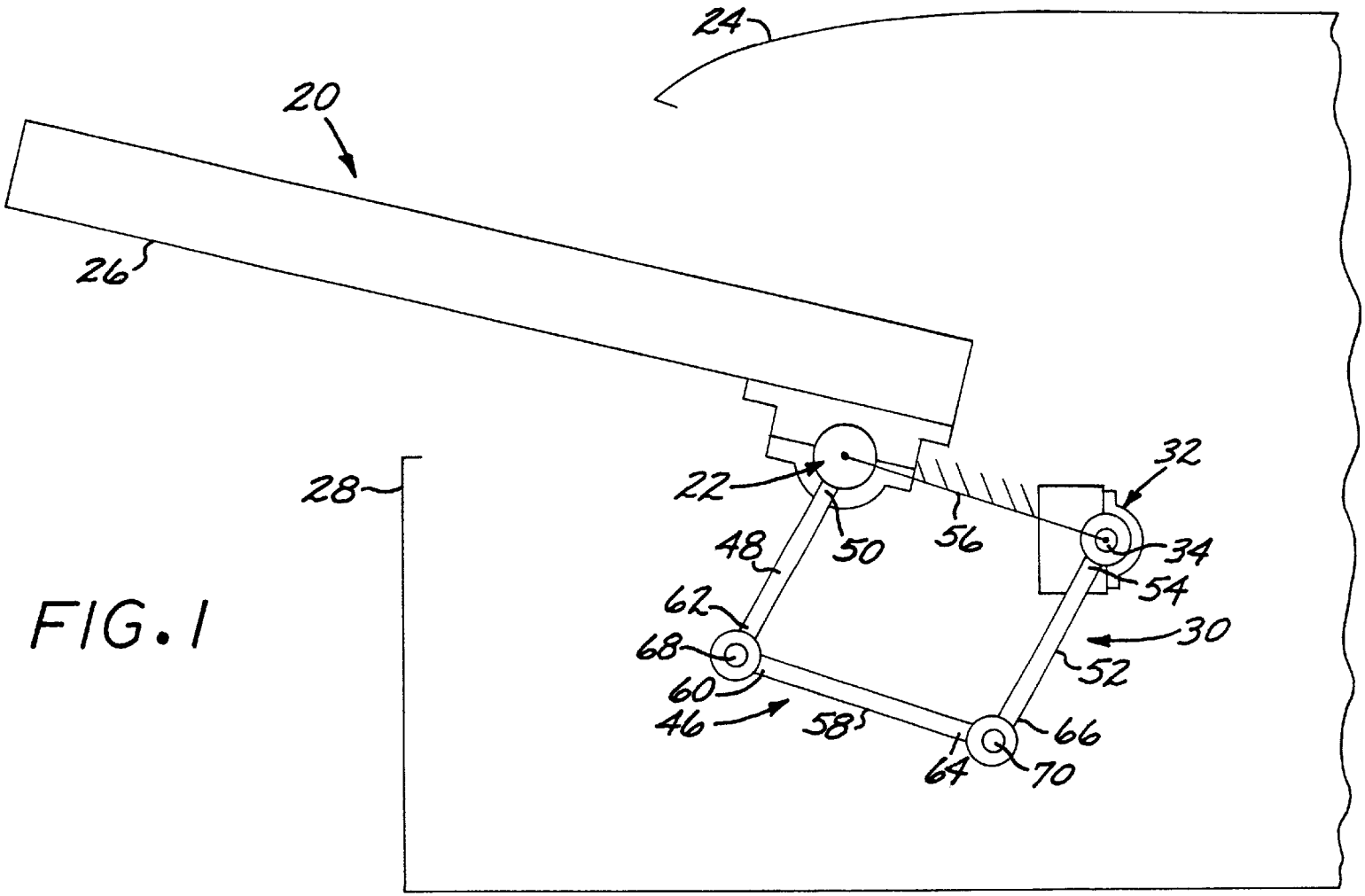
FIG. 1 is a schematic elevational view of a gun with the angular-sensing mechanism of the invention.

FIG. 1 schematically depicts a gun 20 mounted for elevational rotation on a gun trunnion 22 within a turret 24 of a tank. A barrel 26 of the gun 20 protrudes from turret 24 through an opening 28. The elevational position of the barrel 26 is measured by its rotation about the gun trunnion 22. The barrel 26 may be raised (i.e., its elevational angle increased) by a clockwise rotation about the gun trunnion 22 in the view of FIG. 1, or lowered (i.e., its elevational angle decreased) by a counter-clockwise rotation about the gun trunnion 22. The present invention permits the automatic, continuous measurement of the elevational angular position of the gun 20 and its gun barrel 26 relative to the gun trunnion 22.

Figure 2:
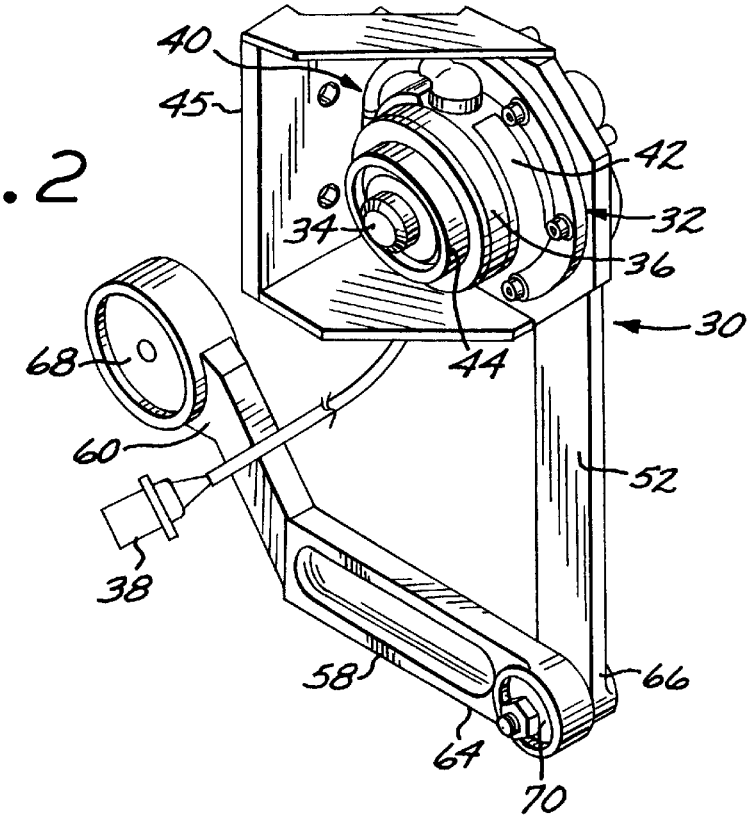
FIG. 2 is a perspective view of a working prototype of the angular-sensing mechanism for use on an M60A3 tank.

A gun trunnion angular-sensing mechanism 30, illustrated schematically in FIG. 1 and in a working-prototype form in FIG. 2, includes an angular-position readout device 32 having an input shaft 34. The angular-position readout device 32 includes a readout sensor 36, which is preferably an angular resolver of the inductance type which senses the angular position of the input shaft 34. As the shaft 34 is rotated, its angular position is provided by the readout sensor 36 as an output signal on the cable 38. The input shaft 34 is desirably supported on a bearing structure 40 which stabilizes the input shaft 34 against lateral or cocking movement. The bearing structure 40 preferably includes a forward bearing 42 that is a double-row, angular contact ball bearing and an aft bearing 44, spaced apart from the forward bearing 42, that is a single-row ball bearing. The entire angular-position readout device 32 is supported on a bracket 45 for mounting to a base structure.

The mechanism 30 further includes a linkage 46 having two pinned joints and extending between the gun trunnion 22 and the input shaft 34 of the angular-position readout device 32. The linkage 46 rotates the input shaft 34 proportionately to a rotation of the gun 20 and its gun barrel 26 on the gun trunnion 22. It is preferred that the constant of proportionality be unity, so that the rotation of the input shaft 34 is exactly the same as that of the barrel 26 about the trunnion 22. The preferred linkage 46 described next accomplishes this preferred identical rotation of the input shaft 34 responsive to that of the gun 20.

Figure 3:
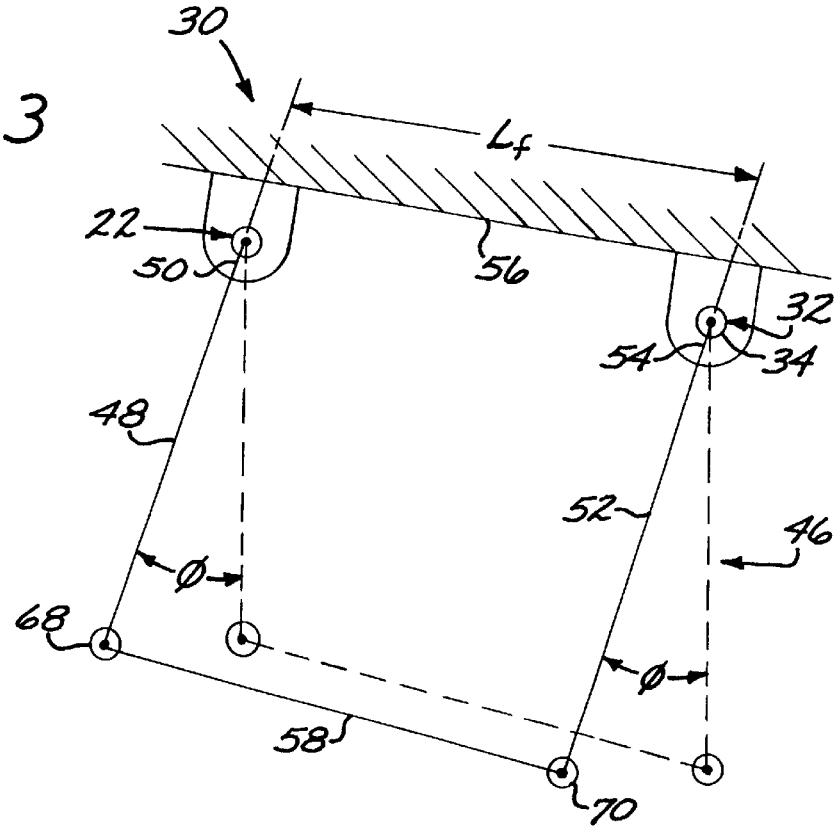
FIG. 3 is a schematic drawing of the functioning of the angular-sensing mechanism.

The linkage 46 is preferably a parallelogram linkage as shown in FIGS. 1 and 3, having four sides with the opposing sides of equal length. The parallelogram linkage 46 has a gun trunnion arm 48 affixed at a first end 50 thereof to the gun trunnion 22. The gun trunnion arm 48 rotates with the gun trunnion 22. In some existing weapons systems, such as the M60A3 tank, the gun trunnion arm 48 is present as an integral part of the gun trunnion 22. Accordingly, the gun trunnion arm 48 is not illustrated in the prototype device of FIG. 2, but it is present as part of the linkage 46 as shown in FIGS. 1 and 3. The gun trunnion arm 48 has a gun trunnion-arm length."

A control arm 52 is oppositely disposed to the gun trunnion arm 48 in the linkage 46, and is parallel to the gun trunnion arm 48. The control arm 52 has a control-arm length equal to the gun trunnion-arm length. The control arm 52 is affixed at a first end 54 thereof to the input shaft 34 of the angular-position readout device 32.

There is a fixed arm 56 of the parallelogram linkage 46 which is a body that is fixed relative to the gun trunnion 22 and the angular-position readout device 32. Typically, the bracket 45 of the angular-position readout device 32 is affixed to the fixed arm 56 body. In practice, the body that forms the fixed arm 56 is a part of the tank structure, such as the wall of the turret 24 or some element fixed to the tank support structure. The fixed-side 56 has a fixed-side length $L_f$ measured between the gun trunnion 22 and the input shaft 34 of the angular-position readout device 32.

The linkage 46 further includes a linkage arm 58 having a linkage-arm length equal to the fixed-side length $L_f$, to which it is oppositely disposed in the linkage 46. The linkage arm 58 is pivotably attached at a first end 60 thereof to a second end 62 of the gun trunnion arm 48. The linkage arm 58 is pivotably attached at a second end 64 thereof to a second end 66 of the control arm 52. As shown in FIG. 2, the linkage arm 58 (or any of the other arms 48, 46, and 56 of the linkage 46) may be bent out of plane to avoid an obstacle or to fit better with the adjacent arms.

The linkage 46 includes a first pivotable attachment 68 between the first end 60 of the linkage arm 58 and the second end 62 of the gun trunnion arm 48. The first pivotable attachment 68 provides a pinned joint between the linkage arm 58 and the gun trunnion arm 48. The first pivotable attachment 68 is preferably a double-row, angular contact, ball bearing. 58 and the gun trunnion arm 48. The first pivotable attachment 68 is preferably a double-row, angular contact, ball bearing.

The linkage 46 also includes a second pivotable attachment 70 between the second end 64 of the linkage arm 58 and the second end 66 of the control arm 52. The second pivotable attachment 70 provides a pinned joint between the linkage arm 58 and the control arm 52. The second pivotable attachment 70 is preferably a double-row, angular contact, ball bearing.

FIG. 3 illustrates the manner of operation of the gun trunnion angular-sensing mechanism 30. When the gun trunnion arm 48, whose first end 50 is affixed to the gun trunnion 22 and rotates by an angle $\phi$ from an initial position indicated by the solid lines to a final position indicated by the dashed lines, the control arm 52 rotates by the same angle $\phi$. The first end 54 of the control arm 52 is affixed to the input shaft 34, so that the input shaft 34 is rotated by the same angle $\phi$.

A trunnion angular-sensing mechanism 30 like that shown in FIG. 2 was constructed and installed in an M60A3 tank. The tank was operated in a live-fire demonstration. The elevation of the gun was continuously measured using the trunnion angular-sensing mechanism 30 while the tank drove a test course. The accurate firing of the gun was accomplished while the tank was in motion using the elevation angular information provided to the fire-control computer of the tank. It had been previously impossible to accomplish such precision control of the firing of the gun of the M60A3 tank while the tank was in motion.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A gun trunnion angular-sensing mechanism operable with a gun mounted for elevational rotation on a gun trunnion, comprising:

an angular-position readout device comprising an angular position sensor and having an input shaft; and a linkage including two pinned joints and extending between the gun trunnion and the input shaft of the angular-position readout device, the linkage rotating the input shaft proportionately to a rotation of the gun on the gun trunnion, and wherein the input shaft of the angular position readout device is supported on a bearing structure.

2. The angular-sensing mechanism of claim 1, wherein the angular-position readout device is an angular resolver.

3. The angular-sensing mechanism of claim 1, wherein the linkage is a parallelogram linkage.

4. The angular-sensing mechanism of claim 1, wherein the linkage is a parallelogram linkage having a gun trunnion arm affixed at a first end thereof to the gun trunnion and rotating with the gun trunnion, the gun trunnion arm having a gun trunnion-arm length, a control arm parallel to the gun trunnion arm and having a control-arm length equal to the gun trunnion-arm length, the control arm being affixed at a first end thereof to the input shaft of the angular-position readout device, a fixed arm comprising a body which is fixed relative to the gun trunnion and the angular-position readout device, and having a fixed-side length measured between the gun trunnion and the input shaft of the angular-position readout device, and a linkage arm having a linkage-arm length equal to the fixed-side length, the linkage arm being pivotably attached at a first end thereof to a second end of the gun trunnion arm and being pivotably attached at a second end thereof to a second end of the control arm.

5. The angular-sensing mechanism of claim 1, wherein the rotation of the input shaft is the same as the rotation of the gun trunnion.

6. The angular-sensing mechanism of claim 1, wherein the gun is a gun in a turret of a tank.

7. The angular-sensing mechanism of claim 1, wherein the angular-position readout device produces an angular position output signal on a cable.

8. The angular-sensing mechanism of claim 1, further including a fire-control computer that receives an output signal of the angular-position readout device.

9. The angular-sensing mechanism of claim 1, wherein at least one of the pinned joints includes a pivotable attachment comprising a double-row, angular contact, ball bearing.

10. A gun trunnion angular-sensing mechanism operable with a gun mounted for elevational rotation on a gun trunnion, comprising:

an angular-position readout device comprising an angular position sensor and having an input shaft, wherein the input shaft of the angular position readout device is supported on a bearing structure; and a linkage rotating the input shaft by the same amount as a rotation of the gun trunnion, the linkage comprising a gun trunnion arm affixed at a first end thereof to the gun trunnion and rotating with the gun trunnion, the gun trunnion arm having a gun trunnion-arm length, a control arm parallel to the gun trunnion arm and having a control-arm length equal to the gun trunnion-arm length, the control arm being affixed at a first end thereof to the input shaft of the angular-position readout device, a fixed arm comprising a body which is fixed relative to the gun trunnion and the angular-position readout device, and having a fixed-side length measured between the gun trunnion and the input shaft of the angular-position readout device, and a linkage arm having a linkage-arm length equal to the fixed-side length, the linkage arm being pivotably attached at a first end thereof to a second end of the gun trunnion arm and being pivotably attached at a second end thereof to a second end of the control arm.

11. The angular-sensing mechanism of claim 10, wherein the gun trunnion arm is integral with the gun trunnion.

12. The angular-sensing mechanism of claim 10, wherein the angular-position readout device is an angular resolver.

13. The angular-sensing mechanism of claim 10, wherein the gun is in a turret of a tank.

14. The angular-sensing mechanism of claim 10, wherein the angular-position readout device produces an angular position output signal on a cable.

15. The angular-sensing mechanism of claim 10, further including a fire-control computer that receives an output signal of the angular-position readout device.

16. A gun trunnion angular-sensing mechanism operable with a gun mounted for elevational rotation on a gun trunnion, comprising:

an angular-position readout device comprising an input shaft, an angular position sensor that reads an angular position of the input shaft, and an input-shaft bearing structure supporting the input shaft; and a linkage rotating the input shaft by the same amount as a rotation of the gun trunnion, the linkage comprising a gun trunnion arm affixed at a first end thereof to the gun trunnion and rotating by the same amount as the gun trunnion, the gun trunnion arm having a gun trunnion-arm length, a control arm parallel to the gun trunnion arm and having a control-arm length equal to the gun trunnion-arm length, the control arm being affixed at a first end thereof to the input shaft of the angular-position readout device, a fixed arm comprising a body which is fixed relative to the gun trunnion and the angular-position readout device, and having a fixed-side length measured between the gun trunnion and the input shaft of the angular-position readout device, and a linkage arm having a linkage-arm length equal to the fixed-side length, a first pivotable attachment between a first end of the linkage arm and a second end of the gun trunnion arm, and a second pivotable attachment between a second end of the linkage arm and a second end of the control arm.

17. The angular-sensing mechanism of claim 16, wherein the angular position sensor is of the inductance type.

18. The angular-sensing mechanism of claim 16, wherein the first pivotable attachment comprises a first double-row, angular contact, ball bearing.

19. The angular-sensing mechanism of claim 16, wherein the second pivotable attachment comprises a second double-row, angular contact, ball bearing.

20. The angular-sensing mechanism of claim 16, wherein the gun trunnion arm is integral with the gun trunnion.

21. The angular-sensing mechanism of claim 16, wherein the angular-position readout device is an angular resolver.

22. The angular-sensing mechanism of claim 16, wherein the angular-position readout device produces an angular position output signal on a cable.

23. The angular-sensing mechanism of claim 16, further including a fire-control computer that receives an output signal of the angular-position readout device.

* * * * *